United States Patent [19]

Hodgson et al.

[11] 4,187,877

[45] Feb. 12, 1980

[54] COMPENSATED WORK PORT FLUID VALVES

[75] Inventors: Robert F. Hodgson; John D. Petro, both of Youngstown, Ohio

[73] Assignee: Commercial Shearing Inc., Youngstown, Ohio

[21] Appl. No.: 927,767

[22] Filed: Jul. 25, 1978

Related U.S. Application Data

[63] Continuation-in-part of Ser. No. 540,402, Jan. 13, 1975, abandoned.

[51] Int. Cl.[2] ..... F15B 13/04

[52] U.S. Cl. ..... 137/596; 91/446; 137/596.13; 137/625.68

[58] Field of Search ..... 91/446; 137/596, 596.12, 137/596.13, 625.68

[56] References Cited

U.S. PATENT DOCUMENTS

| | | | |
|---|---|---|---|
| 2,988,106 | 6/1961 | Rue | 137/596.12 |
| 3,136,328 | 6/1964 | Hipp | 137/596.13 X |
| 3,707,988 | 1/1973 | Hodgson | 137/596.12 |
| 3,774,635 | 11/1973 | Farrell et al. | 137/625.68 X |
| 3,910,311 | 10/1975 | Wilke | 137/596 |
| 3,985,153 | 10/1976 | Thomas | 137/596 |
| 4,095,617 | 6/1978 | Hodgson | 137/596.13 |
| 4,117,862 | 10/1978 | Qureshi | 137/625.68 X |

FOREIGN PATENT DOCUMENTS

| | | | |
|---|---|---|---|
| 1273943 | 7/1968 | Fed. Rep. of Germany | 137/596 |
| 2600776 | 7/1976 | Fed. Rep. of Germany | 137/596 |
| 2647140 | 4/1978 | Fed. Rep. of Germany | 137/596 |
| 2649775 | 5/1978 | Fed. Rep. of Germany | 137/596 |
| 503030 | 4/1976 | U.S.S.R. | 137/596.13 |
| 543716 | 3/1977 | U.S.S.R. | 137/596 |

*Primary Examiner*—Gerald A. Michalsky
*Attorney, Agent, or Firm*—Buell, Blenko & Ziesenheim

[57] ABSTRACT

A compensated work port fluid valve is provided wherein a directional control valve having an inlet chamber, an outlet chamber and a work chamber is provided with a compensator valve connected to the work chamber and having a pressure sensing compensator valve controlling the flow of fluid from the work chamber to a work port to maintain constant pressure at the work port.

9 Claims, 4 Drawing Figures

COMPENSATED WORK PORT FLUID VALVES

This application is a continuation-in-part of our copending application Ser. No. 540,402, filed Jan. 13, 1975, now abandoned.

This invention relates to compensated work port fluid valves and particularly to a work port compensator valve which may be combined with the outlet port of a conventional directional control valve to provide pressure compensation to the valve combination.

Pressure compensation of directional control valves is not new and has been provided in a variety of forms and configurations. Heretofore, however, pressure compensation has primarily been carried out by providing a special inlet section coupled with a modified form of directional control valve configuration. Typical of such prior art valve combinations are those illustrated in Hodgson U.S. Pat. Nos. 3,707,988 and 3,565,110, Strample U.S. Pat. No. 3,602,104, Holt Pat. No. 3,602,243, Rice et al. U.S. Pat. No. 3,255,777 and Allen U.S. Pat. No. 3,234,957. All of these structures are designed to supply a constant volume of fluid, however, none of these structures can be adapted to standard closed center or open center directional control valves. The present invention provides a compensator valve element for use in an axial chamber of the directional control valve spool at the work port of conventional closed center or open center directional control valves for self compensation of the valve with but slight modification of the directional control valve spool.

In the present invention we provide a compensator bore extending axially of the end of the spool of a directional control valve which is to be compensated, axially spaced radial passages intermediate the ends of the compensator bore communicate through the wall of the directional control valve, a compensator spool having lands at each end separated by a central annular groove movable axially within said bore from a first position at one end of the compensator bore wherein the land at one end of the spool closes one set of axially spaced radial passages to a second position in which the other land closes the other set of axially spaced radial passages through a series of intermediate positions in which the two sets of radial passages are in communication through the compensator bore around the groove in the compensator spool to varying degrees depending on the position of the spool, resilient biasing means in one end of the compensator bore acting on the compensator spool to move it to the opposite end of the compensator bore from the biasing means, a first connection through the directional control valve spool to the compensator bore at said one end having the biasing means whereby pressure fluid in a work chamber of the directional control valve cooperates with the resilient biasing means in biasing the compensator spool away from said one end and a second connection through said compensator valve spool from said spool groove through the spool end opposite the biasing means at said other end of the compensator bore whereby the end of the compensator spool is pressurized at the pressure in the groove of the compensator spool. This structure provides a work section compensator controlled by the separate $\Delta p$ from the interior of the spool to the work port without affecting the $\Delta p$ of any other compensator in the system. In addition, the pressure from the work port to exhaust is regulated, which cannot be done with any of the usual compensator systems. As a result, metering of fluid at a controlled rate to exhaust is permitted. Preferably the work section compensator is used in conjunction with a conventional compensated directional control valve such as that shown in Hodgson U.S. Pat. No. 3,565,110 for maximum flexibility and efficiency. The invention will accordingly be hereafter specifically described in conjunction with such a valve.

In the foregoing general description we have set out certain objects, purposes and advantages of our invention. Other objects, purposes and advantages of this invention will be apparent from a consideration of the following description and the accompanying drawings in which:

FIG. 1 is a sectional view of a compensator according to this invention combined with a compensated valve of the type illustrated in Hodgson U.S. Pat. No. 3,707,988;

Figure 1:
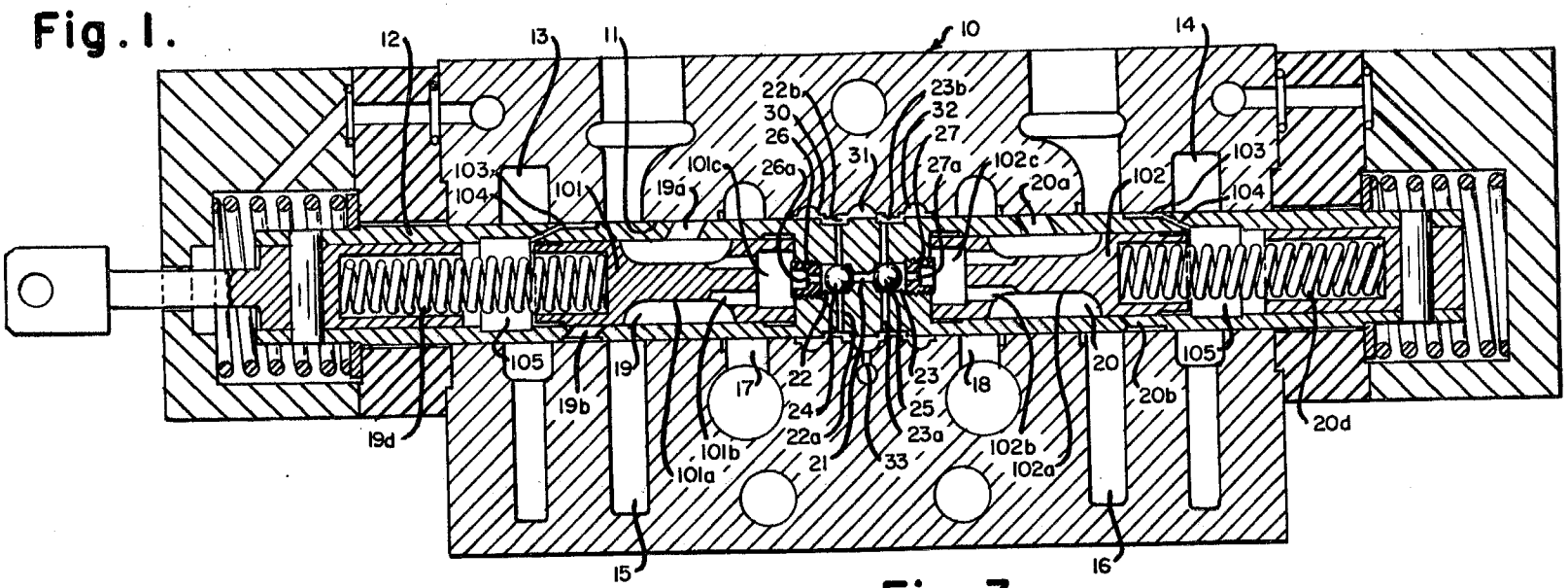

Referring to the drawings, we have illustrated a compensated directional control valve of the type illustrated in FIG. 1 of Hodgson U.S. Pat. No. 3,707,988 but incorporating the structure of this invention. The same reference numbers used in U.S. Pat. No. 3,707,988 have been used here for like parts. In the drawings we provide a closed center valve housing 10 having an axial bore 11 carrying a spool or valve member 12. The housing 10 is provided with spaced exhaust chamber 13 and 14 adjacent each end intersecting bore 11, a pair of work chambers 15 and 16, one adjacent each exhaust chamber and each adapted to be connected to the opposite sides of a fluid motor. Between the two work chambers are spaced inlet chambers 17 and 18. The valve member 12 is hollow at each end to provide a pair of spaced internal chambers 19 and 20 extending axially of the valve member and connected by an axial passage 21 and ball chambers 22 and 23 at each end of said passage. The ball chambers are provided with freely movable balls 24 and 25 held in place by plugs 26 and 27 threaded into the ends of chambers 22 and 23 and each provided with a passage **26*a* and 27*a* respectively. Each of chambers 22 and 23 is provided with passages 22*a* and 23*a* extending radially to the periphery of the valve member. The chamber 20 is provided with two sets of radial openings 20*a* and 20*b* and chamber 19 is provided with a corresponding set of radial openings 19*a* and 19*b*. Openings 19*a* and 20*b* are separated from openings 19*a* and 20*a* respectively by compensator valves 101 and 102 within the chamber operated by springs 19*d* and 20*d*. A pair of annular grooves 22*b* and 23*b* surround the valve member in communication with passages 22*a* and 23*a* of the directional control valve member. When the valve spool 12 is shifted to the right viewing FIG. 1, the openings 20*a* are opened to work chamber 16 while openings 20*b* are open to outlet or exhaust chambers 14. At the same time, openings 19*a* are opened to inlet chamber 16 and openings 19*b* are opened to work chamber 15**.

The compensator valve spools 101 and 102 are each provided with an annular groove **101*a* and 102*a* respectively intermediate their ends and with axial passages 101*b* and 102*b* extending from said groove to a well 101*c* and 102*c* at the end thereof and delivering fluid from the groove area to the end of the valve spool to pressurize the end of the spool. A metering slot 103 is provided adjacent each end of spool 12 and is connected to the two bores 19 and 20 by pressure sensing passage 104 opening into the area 105 behind each of spools 101 and 102**.

As soon as the shift of spool to the right brings opening 20*a* into communication with work passage 16, fluid in passage 16 enters around groove 102*a* and passes through passages 102*b* to well 102*c* which causes spool 102 to also move right. At the same time, exhaust port 14 communicates with the area 105 through passage 104 and slot 103. This pressurizes the end of spool 102 to the pressure of exhaust system. On the other end of spool 12, opening 19*a* connects inlet 17 through groove 101*a* and opening 19*b* with work port 15 while the well 101*c* is pressurized through passages 101*b* and the area 105 is pressurized through passage 104 and slot 103 to the pressure of the work port 15. Thus the position of spool 101 is directly controlled by the $\Delta p$ between inlet and work port while the position of spool 102 is directly controlled by the $\Delta p$ between work port and exhaust port. This provides local compensation without affecting the $\Delta p$ of the main compensator.

Moving valve spool 12 in the opposite direction, simply reverses the operation and the flow of fluid. Here also the valve housing is provided with annular grooves 30, 31 and 32 which when the valve is in neutral are open to radial passages 22*a* and 23*a* with fluid moving freely between them and grooves 22*b* and 23*b* in the valve member. The groove 31 is connected to a radial passage 33 which extends to the outside of housing 10. Grooves 30 and 32 are connected respectively to passages which extend angularly to the outside of housing 10 and connect at the outside of the housing to a common port all as shown in U.S. Pat. No. 3,707,988. The remainder of the valve structure is the same as described in U.S. Pat. No. 3,707,988.

The operation of the primary compensator structure is precisely as described in U.S. Pat. No. 3,707,988. The work port compensator of this invention is described above. In order for the work port compensator of this invention to operate, it is essential that the embodied are of passages operate, it is essential that the combined area of passages 102*b* and 101*b* be greater than passages 27*a* and 26*a* respectively.

Figure 2:
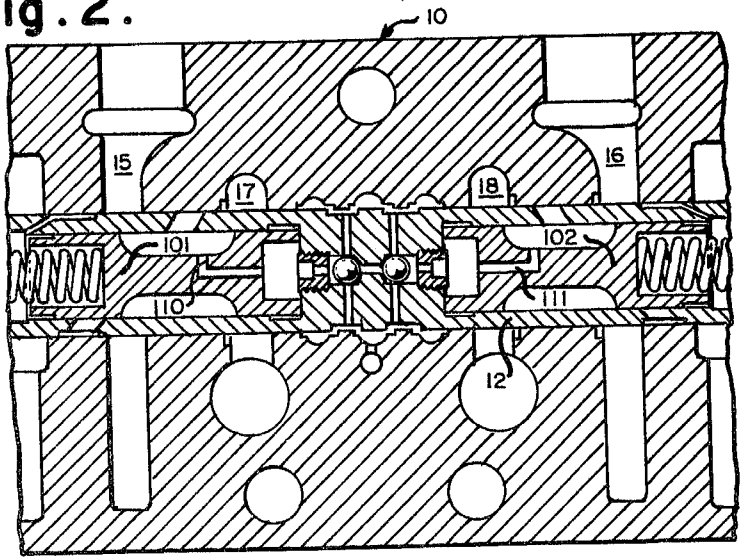
FIG. 2 is a fragmentary sectional view through a second embodiment of compensator valve according to this invention.

In FIG. 2 we have illustrated a second embodiment of our invention in which those parts identical to FIG. 1 bear like numerals. The difference in structure lies in the different arrangement for communicating between wells 101*c* and 102*c* and grooves 101*a* and 102*a*. In this embodiment a transverse passage 110 is provided through the spool at the groove and an axial passage 111 extends from each well to the transverse passage. Operation of the valve is the same.

Figure 3:
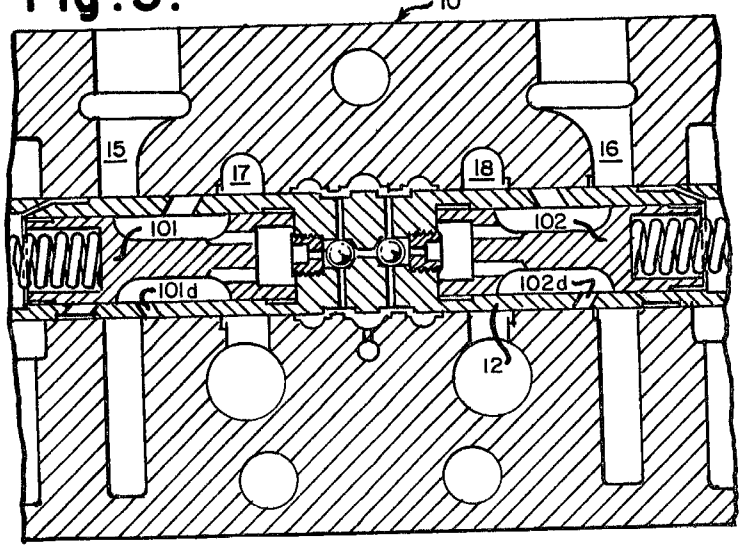
FIG. 3 is a fragmentary sectional view of a modified embodiment of FIG. 1.

In FIG. 3 we have illustrated a modified form of the valve of FIG. 1 in which the compensator spool valves 101 and 102 can be made to act as relief valves on exhaust by inserting radial passages 101*d* and 102*d* in spool 12. These passages eliminate compensation on exhaust but do not affect compensation on the work side of the valve.

Figure 4:
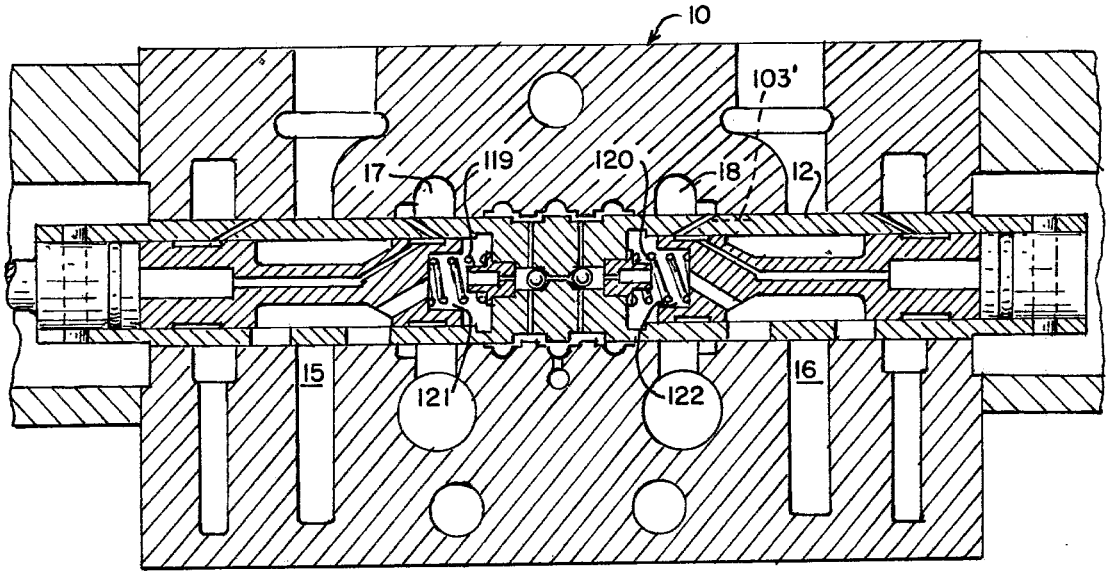
FIG. 4 is a fragmentary sectional view of a third embodiment of compensator valve according to this invention.

In FIG. 4 we have illustrated a third embodiment of the invention in which the biasing springs 119 and 120 are placed in wells 121 and 122 at the center of the spool, precisely opposite to the springs 19*d* and 20*d* of FIG. 1, so that their biasing effect is toward the spool end rather than the spool center as in FIG. 1.

A metering slot 103' as shown in dotted lines similar to that shown in FIG. 1 may be provided in the valve of FIG. 4, if desired.

In the foregoing specification we have described certain preferred embodiments and practices of our invention, however, it will be understood that this invention may be otherwise embodied within the scope of the following claims.

We claim:

1. A compensated work port fluid valve comprising a directional control valve having a housing with inlet and outlet ports, a bore extending through said housing, a valve member movable in said bore, a pair of spaced inlet chambers intersecting said bore generally centrally thereof and connected to the inlet port, a pair of work chambers spaced from and on opposite sides of said inlet chambers, a pair of outlet chambers intersecting on opposite sides of said work chambers from the inlet chambers, said work chambers being adapted to be alternatively connected to one of said inlet chambers in one position of the valve member and to one of the outlet chambers in a second position of said valve member, an axial bore in each end of said valve member extending from one end to a point adjacent the center thereof and forming two spaced axial chambers, selectively communicating with one another and with a first pressure sensing passage in the housing intermediate the inlet chambers, a compensator spool movable in each said axial bore, each compensator spool having a groove intermediate its ends, spaced apart radial passages in each chamber communicating through the valve member to said bore, said passages being spaced so as to connect alternatively the work chamber with one of the adjacent inlet and outlet chambers, a second pressure sensing passage through the valve member to each said axial bore adjacent the end of the valve member, resilient means in each said axial bore urging each compensator spool toward one end of each said axial bore in the valve member and passage means connecting each compensator spool groove with the axial bore at the end adjacent the center of the valve member whereby pressure in the compensator spool groove acts on the compensator spool end and on the first pressure sensing passage and the selective communication between the chambers to connect the spaced radial passages and to meter flow therethrough.

2. A compensated work port fluid valve as claimed in claim 1 wherein passages in the compensator spool are generally parallel to the spool axis.

3. A compensated work port fluid valve as claimed in claim 1 wherein each end of the compensator is provided with an axial well.

4. A compensated work port fluid valve as claimed in claim 1 wherein the second pressure sensing passage includes a metering slot in the surface of the valve member.

5. A compensated work port fluid valve comprising a directional control valve having a housing with inlet and outlet ports, a bore extending through said housing, a valve member movable in said bore, a pair of spaced inlet chambers intersecting said bore and connected to the inlet port, a pair of work chambers spaced from and on opposite sides of said inlet chambers, a pair of outlet chambers intersecting said bore on opposite sides of said work chambers from the inlet chambers, said work chambers being adapted to be connected alternatively to one of said inlet chambers in one position of the valve member and to one of the outlet chambers in a second position of said valve member, an axial bore in each end of said valve member extending from one end to a point adjacent the center thereof and forming two spaced axial chambers selectively communicating with one another and with a first pressure sensing passage in the housing intermediate the inlet chamber, a compensator spool movable in each said axial bore, each compensator spool having a groove intermediate its ends, spaced apart radial passages in each chamber communicating through the valve member to said bore, said passages being spaced so as to connect alternatively the work chamber with one of the adjacent inlet and outlet chambers, a second pressure sensing passage through the valve member to each said axial bore adjacent the end of the valve member, resilient means in each said axial bore urging each compensator spool toward the center of the valve member and passage means connecting each compensator spool groove with the axial bore at the end adjacent the center of the valve member whereby pressure in the compensator spool groove acts on the compensator spool end and on the first pressure sensing passage and the selective communication between the chambers, to connect the spaced radial passages and to meter flow therethrough.

6. A compensated work port fluid valve as claimed in claim 5 wherein passages in the compensator spool are generally parallel to the spool axis.

7. A compensated work port fluid valve as claimed in claim 5 wherein each end of the compensator is provided with an axial well.

8. A compensated work port fluid valve as claimed in claim 5 wherein the second pressure sensing passage includes a metering slot in the surface of the valve member.

9. A compensated work port fluid valve comprising a directional control valve having a housing with inlet and outlet ports, a bore extending through said housing, a valve member movable in said bore, a pair of spaced inlet chambers intersecting said bore generally centrally thereof and connected to the inlet port, a pair of work chambers spaced from and on opposite sides of said inlet chambers, a pair of outlet chambers intersecting said bore on opposite sides of the work chambers from the inlet chamber, said work chambers being adapted to be connected alternatively to one of said inlet chambers in one position of the valve member and to one of the outlet chambers in a second position of said valve member, an axial bore in each end of said valve member extending from one end to a point adjacent the center thereof and forming two spaced axial chambers selectively communicating with one another and with a first pressure sensing passage in the housing intermediate the inlet chambers, a compensator spool movable in each said axial bore, each compensator spool having a groove intermediate its ends, spaced apart radial passages in each chamber communicating through the valve member to said bore, said passages being spaced so as to connect alternatively the work chamber with one of the adjacent inlet and outlet chambers, a second pressure sensing passage through the valve member to each said axial bore adjacent the end of the valve member, resilient means in each said axial bore between the compensator spool and the end of the bore adjacent the center of the valve member urging each compensator spool toward one end of each said axial bore in the valve member and passage means connecting each compensator spool groove with the axial bore at the end adjacent the resilient means in the valve member whereby pressure in the compensator spool groove acts on the compensator spool end and on the first pressure sensing passage and the selective communication between the chambers to connect the spaced radial passages and to meter flow therethrough.

* * * * *